US005551128A

United States Patent [19]

Townsend

[11] Patent Number: 5,551,128

[45] Date of Patent: Sep. 3, 1996

[54] STRAP FOR HOLDING LAUNDRY

[75] Inventor: Richard L. Townsend, DeKalb, Ill.

[73] Assignee: Adams USA, Inc., Cookeville, Tenn.

[21] Appl. No.: 411,012

[22] Filed: Mar. 27, 1995

[51] Int. Cl.[6] ..... A44B 21/00

[52] U.S. Cl. ..... 24/302; 24/DIG. 29

[58] Field of Search ..... 24/3.13, DIG. 29, 24/625, 298, 300, 301, 302

[56] References Cited

U.S. PATENT DOCUMENTS

| | | | |
|---|---|---|---|
| 1,605,845 | 11/1926 | King | 24/625 X |
| 2,167,651 | 8/1939 | Hess | 24/302 X |
| 2,953,828 | 9/1960 | Hochman . | |
| 3,508,303 | 4/1970 | Miyasaka | 24/298 |
| 3,673,639 | 7/1972 | Driscoll | 24/DIG. 29 |
| 3,688,348 | 9/1972 | Klotz et al. . | |
| 3,699,617 | 10/1972 | Hofmeister . | |
| 4,150,464 | 4/1979 | Tracy . | |
| 4,171,555 | 10/1979 | Bakker et al. . | |
| 5,321,855 | 6/1994 | Ciuffo . | |

*Primary Examiner*—James R. Brittain
*Attorney, Agent, or Firm*—Mathew R. P. Perrone, Jr.

[57] ABSTRACT

A strap for holding laundry can hold clothing having a sleeve or a leg and can also have a sock holding device as an integral part thereof.

15 Claims, 2 Drawing Sheets

FIG. 3
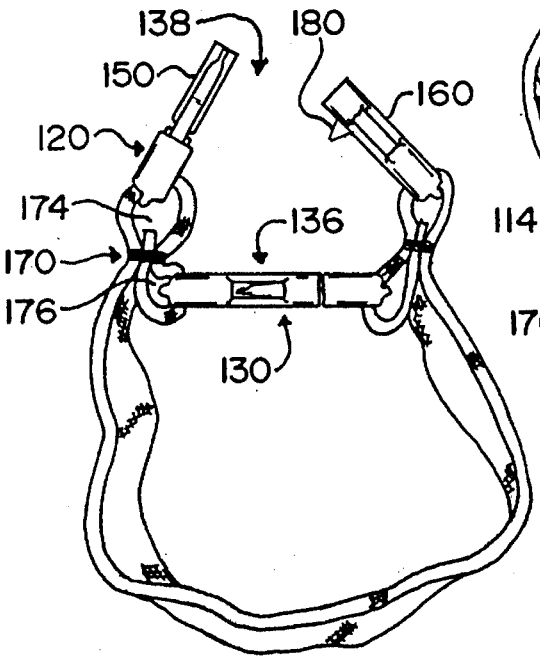
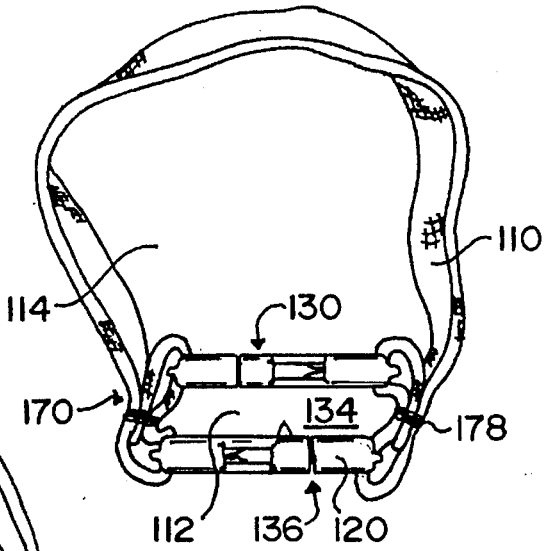
FIG. 2
FIG. 4
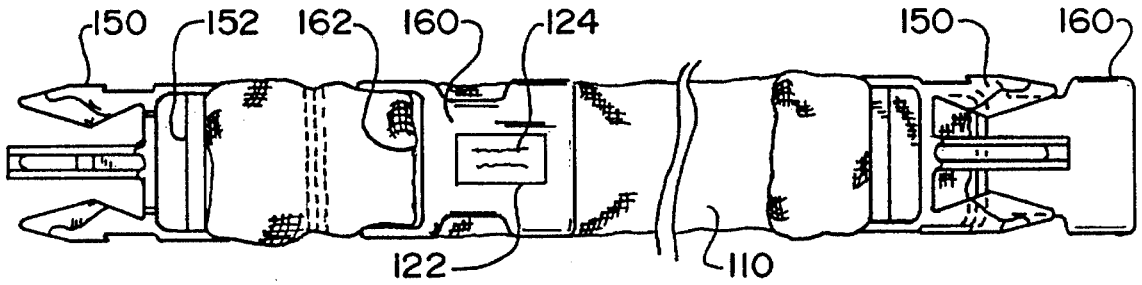
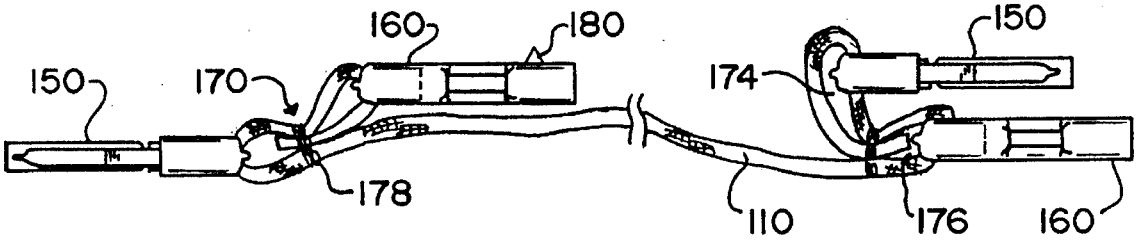
FIG. 5

STRAP FOR HOLDING LAUNDRY

This invention relates to a laundry strap, and more particularly to a strap for holding laundry suitable for holding clothes and socks together while being efficiently washed.

BACKGROUND OF THE INVENTION

Laundry is known to be at least somewhat unpleasant task, if not repugnant task. Not only is home laundry tedious and time-consuming, as the amount of laundry increases, the tedium and time consumption greatly increases.

In athletic departments of many large scale universities, one of the primary difficulties is getting the laundry done in an efficient manner. It is desirable to wash laundry from many different players all together. It is also desirable to make sure that each player gets his or her own laundry back.

Many devices are known to hold laundry together during the course of a washing procedure. However, there is a difficulty with these devices. These devices must leave the laundry free to be washed thoroughly while at the same time being able to efficiently hold the laundry in proper position.

Various problems with washing socks are discussed in U.S. Pat. No. 5,321,855 to Anthony F. Ciuffo. Other problems in doing laundry are well known.

One typical device is an enlarged safety pin type structure. This device must be made of metal in order to have the holding capacity required. Many uniform items must be held on the pin. So the safety pin must be large.

During the laundry or washing process, the metal pin can damage the machines. Also the safety pin becomes hot enough to cause an injury when touched. The metal can also abrade the clothes and cause them to wear out more quickly. It is also difficult to mark the safety pin so that the clothes may be identified.

Using a bag for the laundry of each individual athlete does not permit exposure of the laundry to washing process efficiently. Even a mesh or net bag restricts movement of each piece of clothing so much that cleaning is inefficient.

Many attempts at providing a suitable strap for holding laundry are known. A suitable laundry strap to provide for restricting each individual's laundry is not yet known. For example, while other laundry straps are known, there is still the problem of socks. A strap cannot really hold socks. A bag to hold socks is inefficient and cumbersome to use with the strap.

Other sock holding devices are equally inefficient. A shirt or a pair shorts can have the loop for holding laundry inserted through an aperture for a sleeve hole or a leg hole. A sock does not have such an aperture.

Use of the well-known hook and loop assembly causes a problem, because lint and other laundry residue clog that assembly and are not easily removed therefrom. It is also difficult to mark a strap of that type for identification.

Marking each individual item of laundry is time consuming and detracts from the appearance of the article. Then there is the problem of sorting each individual's items after. Such problems are too time consuming for an efficiently run athletic program at a larger university.

Accordingly, many problems remain to be solved in cleaning and identifying a mass of laundry, then returning the laundry to the rightful user or owner. As above stated, this is especially a problem for an athletic program in a large university.

SUMMARY OF THE INVENTION

Among the many objectives of this invention is the provision of a strap for holding laundry which can also hold a pair of socks.

A still further objective of this invention is to provide a strap for holding laundry with a sock holding device.

Yet a further objective of this invention is to provide a strap for holding laundry with a sock locking device.

Also an objective of this invention is to provide a strap for holding laundry having an easily joined and separated buckle at each end thereof.

Another objective of this invention is to provide a method for making a strap for holding laundry.

Still another objective of this invention is to provide a method for making a strap for holding laundry, which includes a sock holding device.

These and other objectives of the invention (which other objectives become clear by consideration of the specification, claims and drawings as a whole) are met by providing a strap for holding laundry having a sock holding device as an integral part thereof.

BRIEF DESCRIPTION OF THE DRAWINGS

FIG. 2 depicts a perspective view of the strap for holding laundry 100.

FIG. 3 depicts a perspective view of the strap for holding laundry 100, with a buckle 120 in open position.

FIG. 4 depicts a top, plan view of the strap for holding laundry 100 of this invention.

FIG. 5 depicts a side view of the strap for holding laundry 100 of this invention, caused by a ninety (90°) degree rotation of FIG. 4.

Throughout the figures of the drawings, where the same part appears in more than one figure of the drawings, the same number is applied thereto.

DESCRIPTION OF THE PREFERRED EMBODIMENTS

Figure 1:
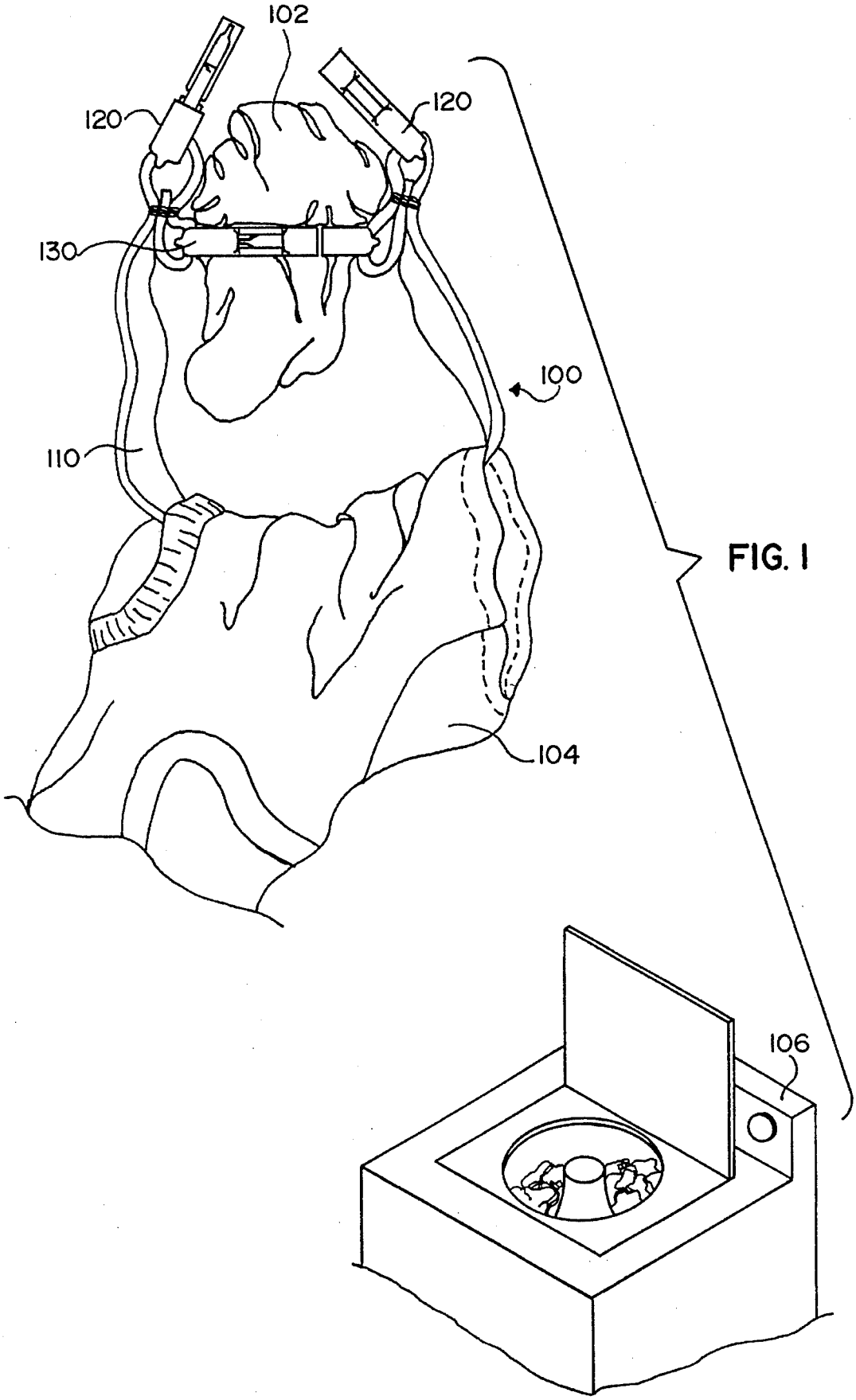
FIG. 1 depicts a perspective of the strap for holding laundry 100 of this invention, including clothes 102 to be washed.

The laundry strap of this invention includes a generally flat elongated piece of material. At each end of the piece of material, two fastening devices are attached. One of these fastening devices can be joined to form a larger loop including the material. This larger loop can be inserted through the legs or sleeves of various pieces of athletic material followed by the closing of the fastening device.

For items that do not have sleeves through which the strap be inserted, the second fastening device cooperates with the first fastening device to form a smaller loop. This smaller loop can frictionally hold the products; that is a non-apertured piece of clothing, such as a pair of socks, therein.

The buckle, or second fastening device, may include a prong inside the buckle loop to further assist the holding of the socks. In this fashion, it is possible to attach together the various pieces of athletic wear required for use in an athletic program.

An especially suitable fastening device for use on laundry strap is described in U.S. Pat. No. 4,150,464 to Richard J. Tracy or U.S. Pat. No. 4,171,355 John A. Bakker et al. This fastening device has a male piece insertable into a female piece. A squeeze on the side of the male piece can release the male piece from the female piece. Usually, the squeeze is accomplished by placing a finger of one hand on one side of the male piece and a thumb of the same hand on the other side of the male piece and squeezing together for a release purpose. Joining is accomplished by sliding and a spring snap.

Preferably speaking, on each end of the strap, a female piece and a male piece of the fastening devices are attached. Thus, the fastening devices are opposed which assist in the holding of the various elements within the second or buckle loop.

The piece of material may be any suitable material, which can endure many washings, and not fray or otherwise wearout for a substantial period of time. Woven or non-woven material may be used. Synthetic material, natural material or combinations thereof may be used for the piece of material.

Preferably, the piece of material forming the strap is up to about fifty (50) centimeters in length. More preferably, the strap is about ten (10) centimeters to about forty-five (45) centimeters long. Most preferably, the strap is about fifteen (15) centimeters to about forty (40) centimeters long.

The piece of material forming the strap preferably has a width of up to about five (5) centimeters. More preferably the width of the strap is about one (1) to about four (4) centimeters. Most preferably, the strap is about two to about three centimeters in width.

As to a thickness of the material forming preferably the thickness thereof is up to about five tenths (0.5) of a centimeter. More preferably, the thickness of the strap is up to about four-tenths (0.4) of a centimeter. Most preferably, the strap is about one-tenth to about three-tenths (0.3) of a centimeter.

While it is not desired to be bound by any particular length, the recited length, width, and thickness provide for the most efficient laundry strap. These dimensions also provide for durability and reliability of the strap.

The space of the second or buckle loop formed between the two buckle assemblies is sufficiently small to frictionally hold the socks or other similar items therebetween. Such space is caused by attaching each buckle adjacent to each end of the flat piece of material such that the each buckle is suitably spaced from the other.

Referring now to FIG. 1, a perspective view of the strap 100 is shown, with socks 102 and a shirt 104 mounted thereon. Strap 100 includes a flat, elongated piece of material 110. The piece of material 110 has a first buckle assembly 120 and a second buckle assembly 130 secured at the end thereof. The first buckle assembly 120 and the second buckle assembly 130 may be of the same type or different.

The thus assembled strap 100 with socks 102 and a shirt 104 may then be placed in washing machine 106, to be run through a washing cycle. Strap 100 may have thereon at least apertured piece of clothing such as shirt 104, or other such apertured clothing having a sleeve or a leg or a similar aperture.

Washing machine 106 may be any suitable clothes washing machine from a standard home washer to a heavy duty industrial washer. After the washing cycle is complete, the strap 100 with clothes attached may be retrieved and returned to the owner.

Adding FIG. 2 to the consideration and assuming that the first buckle assembly 120 and the second buckle assembly 130 are of the same type, the first buckle assembly 120 is a typical side release buckle assembly being very durable and capable of enduring the washing machine.

Material 110 has an inner portion 112 when first buckle assembly 120 is closed and outer portion 114. Clothes with arm holes or leg holes can surround inner portion 112 and outer portion 114.

The first buckle assembly 120 and the second buckle assembly 130 combine to form a sock loop 134 when both are in closed position 136 to hold socks 104. It is possible to put a sock holding protrusion 180 on one or both of the first buckle assembly 120 and the second buckle assembly 130. Sock holding protrusion 180 forms a little bump inside of sock loop 134 and further cooperates to hold the socks 106 (FIG. 1) in position.

Further considering FIG. 3 and FIG. 4, the first buckle assembly 120 and the second buckle assembly 130 are shown here to be the same. However, different buckle assemblies can be used in combination or on the same strap. The shown buckle assembly for first buckle assembly 120 and second buckle assembly 130 is the most efficient and most durable for the purposes of this invention.

Both the closed position 136 and the open position 138 are depicted in FIG. 3. With both first buckle assembly 120 and second buckle assembly 130 in open position 138, material 110 can be inserted through the legs of shorts 102 and arm of shirt 104, or similar articles. First buckle assembly 120 can then be closed. Socks 106 or similar articles can be placed on first buckle assembly 120 and second buckle assembly 130 moved to closed position 136. First buckle assembly 120 and second buckle assembly 130 combine with a sock holding protrusion 180 extending therein to hold socks for washing.

In particular, the first buckle assembly 120 includes a male member 150 and a female member 160. The male member 150 has the male strap receiving aperture 152 for receiving the piece of material 110. The female member 160 has a female strap receiving member 162 for receiving the piece of material 110.

As shown in the drawing, especially FIG. 3 and FIG. 4, the piece of material 110 for strap 100 may be folded in a figure-eight pattern 170 at one end thereof to have a first aperture 174 and a second aperture 176 to receive a second female member 160 and a second male member 150. First aperture 174 may receive a female member 160 or a male member 150 as desired.

Likewise, the piece of material 110 for strap 100 may be folded in a figure-eight pattern 170 at the other end thereof to have a first aperture 174 and a second aperture 176. However, the positions of a second female member 160 and a second male member 150 must be reversed relative to the other end of strap 110. First aperture 174 may receive a female member 160 or a male member 150 as desired.

At this time, one line of stitches 178 can be performed and hold the buckle assemblies in place. Other fastening mechanisms such as gluing mechanisms or melting mechanisms may also be used on the piece of material 110. However, the sewing mechanism and the stitches 178 are known believed to be the most efficient manner of attaching the buckle assemblies thereto.

Referring now to FIG. 4 and FIG. 5, this first buckle 120 assembly also includes a marking surface 122 which may be marked with an identification number 124 to very efficiently get the desired clothes to the desired person. Typically, the identification number 124 can be the uniform number of the player to whom the clothes belong.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A laundry strap for holding at least one article of clothing while being washed comprising:

(a) an elongated piece of flat material having a first end and a second end oppositely disposed from the first end;

(b) a fastening means for releasably joining the first end to the second end;

(c) the fastening means including a first joining means and a second joining means;

(d) the first joining means being secured to the first end;

(e) the second joining means being secured to the second end;

(f) the first joining means including a first female member and a first male member;

(g) the second joining means including a second female member and a second male member;

(h) the first female member being releasably joinable to the second male member to form a primary loop of the elongated piece of flat material;

(i) the second female member being releasably joinable to the first male member to form a secondary loop;

(j) the secondary loop existing between the joined second female member and first male member, and the joined second male member and the first female member;

(k) the first male member including a first squeezable mechanism for releasing the first male member from the second female member;.

(l) the second male member including a second squeezable mechanism for releasing the second male member from the first female member;

(m) the primary loop being suitable for holding at least one apertured piece of clothing;

(n) the secondary loop being suitable for holding at least one piece of clothing;

(o) the secondary loop being suitable for holding at least one non-apertured piece of clothing; and (p) the secondary loop including an additional holding means for securing the at least one non-apertured piece of clothing therein.

2. The laundry strap of claim 1 further comprising the additional holding means being a protrusion from the second female member into the secondary loop.

3. The laundry strap of claim 1 further comprising:

(a) the elongated piece of flat material being up to about fifty centimeters in length; and (b) the elongated piece of flat material being up to about five centimeters in width.

4. The laundry strap of claim 1 further comprising:

(a) the elongated piece of flat material being about 10 to about 45 centimeters in length; and (b) the elongated piece of flat material being about one to about four centimeters in width.

5. The laundry strap of claim 4 further comprising:

(a) the elongated piece of flat material being about 15 to about 40 centimeters in length; and (b) the elongated piece of flat material being about two to about three centimeters in width.

6. The laundry strap of claim 1 further comprising:

(a) the first end having a first primary fastening loop therein and a first secondary fastening loop therein;

(b) the second end having a second primary fastening loop therein and a second secondary fastening loop therein;

(c) the first female member being secured in the first primary fastening loop;

(d) the first male member being secured in the first secondary fastening loop;

(e) the second male member being secured in the second primary fastening loop;

(f) the second female member being secured in the second secondary fastening loop;

(g) the first secondary fastening loop being movable adjacent to the second secondary fastening loop; and (h) the first primary fastening loop being movable adjacent to the first secondary fastening loop.

7. The laundry strap of claim 6 further comprising:

(a) the first primary fastening loop and the first secondary fastening loop being formed in a first figure eight pattern and secured with at least one line of stitches; and (b) the second primary fastening loop and the second secondary fastening loop being formed in a second figure eight pattern and secured with at least one line of stitches.

8. The laundry strap of claim 7 further comprising:

(a) the first female member being joinable to the second male member to form a primary buckle;

(b) the second female member being joinable to the first male member to form a secondary buckle; and (c) the secondary buckle including an identification means thereon.

9. The laundry strap of claim 7 further comprising:

(a) the first female member being joinable to the second male member to form a primary buckle;

(b) the second female member being joinable to the first male member to form a secondary buckle; and (c) the primary buckle including an identification means thereon.

10. A laundry strap for holding at least one article of clothing while being washed comprising:

(a) an elongated piece of flat material having a first end and a second end oppositely disposed from the first end;

(b) a fastening means for releasably joining the first end to the second end;

(c) the fastening means including a first joining means and a second joining means;

(d) the first joining means being secured to the first end;

(e) the second joining means being secured to the second end;

(f) the first joining means including a first female member and a first male member;

(g) the second joining means including a second female member and a second male member;

(h) the first female member being releasably joinable to the second male member to form a primary loop of the elongated piece of flat material;

(i) the second female member being releasably joinable to the first male member to form a secondary loop;

(j) the secondary loop existing between the joined the second female member and the first male member, and the joined the second male member and the first female member;

(k) the first male member including a first squeezable mechanism for releasing the first male member from the second female member;

(l) the second male member including a second squeezable mechanism for releasing the second male member from the first female member;

(m) the primary loop being suitable for holding at least one apertured piece of clothing;

(n) the secondary loop being suitable for holding at least one non-apertured piece of clothing;

(o) the secondary loop including an additional holding means suitable for holding the at least one non-apertured piece of clothing; and (p) the additional holding means being a protrusion from the second female member into the secondary loop.

11. The laundry strap of claim 10 further comprising:

(a) the elongated piece of flat material being about 15 to about 40 centimeters in length; and (b) the elongated piece of flat material being about two to about three centimeters in width.

12. The laundry strap of claim 11 further comprising:

(a) the first end having a first primary fastening loop therein and a first secondary fastening loop therein;

(b) the second end having a second primary fastening loop therein and a second secondary fastening loop therein;

(c) the first female member being secured in the first primary fastening loop;

(d) the first male member being secured in the first secondary fastening loop;

(e) the second male member being secured in the second primary fastening loop;

(f) the second female member being secured in the second secondary fastening loop;

(g) the first secondary fastening loop being movable adjacent to the second secondary fastening loop; and (h) the first primary fastening loop being movable adjacent to the first secondary fastening loop.

13. The laundry strap of claim 12 further comprising:

(a) the first primary fastening loop and the first secondary fastening loop being formed in a first figure eight pattern and secured with at least one line of stitches; and (b) the second primary fastening loop and the second secondary fastening loop being formed in a second figure eight pattern and secured with at least one line of stitches.

14. The laundry strap of claim 13 further comprising:

(a) the first female member being joinable to the second male member to form a primary buckle;

(b) the second female member being joinable to the first male member to form a secondary buckle; and (c) the secondary buckle including an identification means thereon.

15. The laundry strap of claim 13 further comprising:

(a) the first female member being joinable to the second male member to form a primary buckle;

(b) the second female member being joinable to the first male member to form a secondary buckle; and (c) the primary buckle including an identification means thereon.

* * * * *